US006561375B1

(12) United States Patent
Nagy

(10) Patent No.: US 6,561,375 B1
(45) Date of Patent: May 13, 2003

(54) SPILL RESISTANT DISHWARE

(76) Inventor: Giselle F. Nagy, 22947 Valerio St., West Hills, CA (US) 91307

( * ) Notice: Subject to any disclaimer, the term of this patent is extended or adjusted under 35 U.S.C. 154(b) by 0 days.

(21) Appl. No.: 10/222,553

(22) Filed: Aug. 15, 2002

Related U.S. Application Data

(60) Provisional application No. 60/383,276, filed on May 23, 2002.

(51) Int. Cl.[7] ..... A47G 19/00; B65D 73/00

(52) U.S. Cl. ..... 220/574; 220/737; 220/592.17; 206/460; 206/515

(58) Field of Search ..... 220/574, 632, 220/633, 635, 737, 592.17; 206/460, 515

(56) References Cited

U.S. PATENT DOCUMENTS 1,873,120 A * 8/1932 Hall ..... 131/240.1
1,938,909 A * 12/1933 Huff ..... 220/574
2,053,949 A * 9/1936 Emery ..... 220/574
3,080,997 A * 3/1963 Brown ..... 220/606
3,622,036 A * 11/1971 Bongaerts ..... 220/574
3,847,324 A 11/1974 Uchanski et al.
4,046,250 A 9/1977 Amezcua
4,767,005 A * 8/1988 Onuma et al. ..... 206/710
4,910,056 A * 3/1990 Mitoh et al. ..... 428/41.3
4,961,555 A 10/1990 Egan, Jr.
5,005,704 A 4/1991 Martin
5,485,937 A * 1/1996 Tseng ..... 220/571
5,542,577 A 8/1996 Friedrich
5,564,567 A * 10/1996 Weder ..... 206/423
5,873,486 A 2/1999 Morgan
6,074,720 A 6/2000 Van Stratum
6,286,798 B1 9/2001 Chun
6,415,944 B1 * 7/2002 Toussant ..... 220/574

* cited by examiner

*Primary Examiner*—Joseph M. Moy
(74) *Attorney, Agent, or Firm*—Jack C. Munro

(57) ABSTRACT

Spill resistant dishware which has a bottom annular edge with this bottom annular edge adapted to rest on a supporting surface. A low tack adhesive is applied to the bottom annular edge. This dishware is capable of being fixed in position on the supporting surface by the adhesive with said dishware to remain in this position even during breezy conditions. However, the adhesive permits easy disengagement of the dish and resecurement of the dish on the supporting surface. This dishware's novel design allows the dishware to be stacked one upon the other without any adhesive coming into contact with the food or liquid holding compartments of the underlying dishware, without the need for adhesive liners.

15 Claims, 4 Drawing Sheets

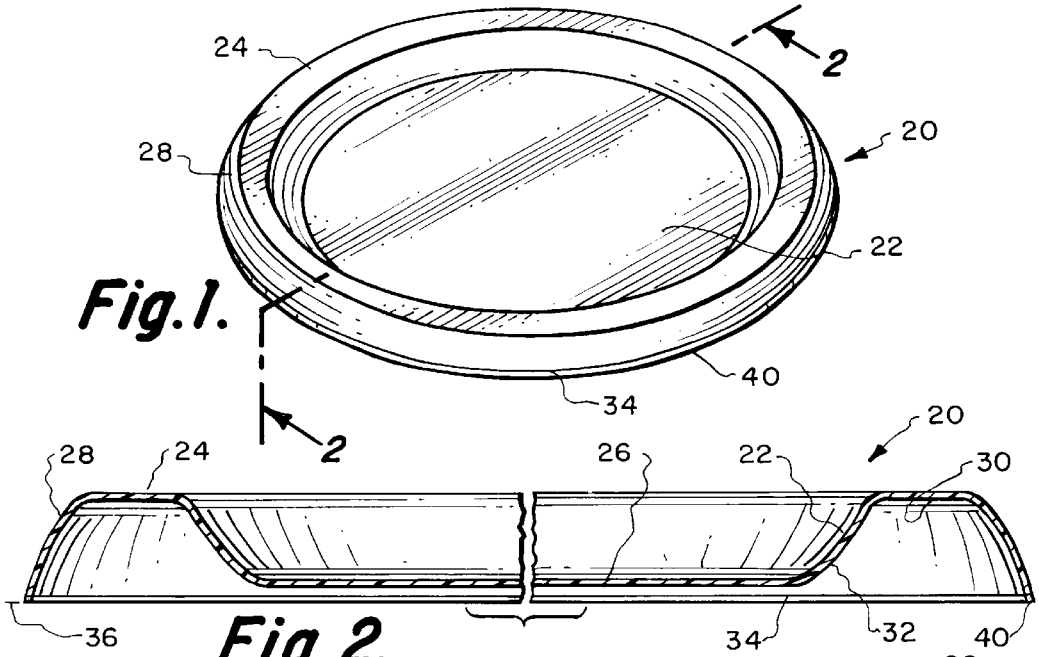
Fig. 1.
Fig. 2.
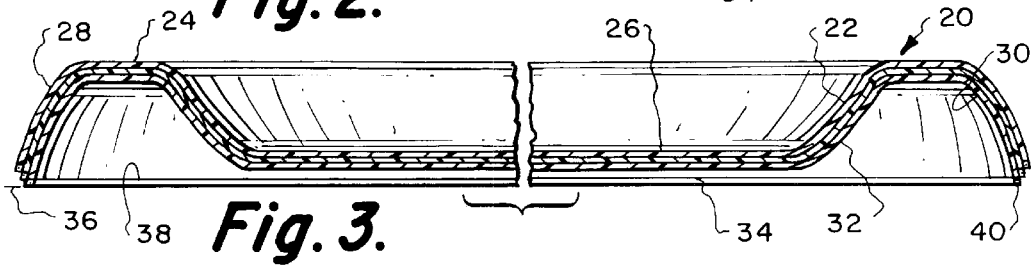
Fig. 3.
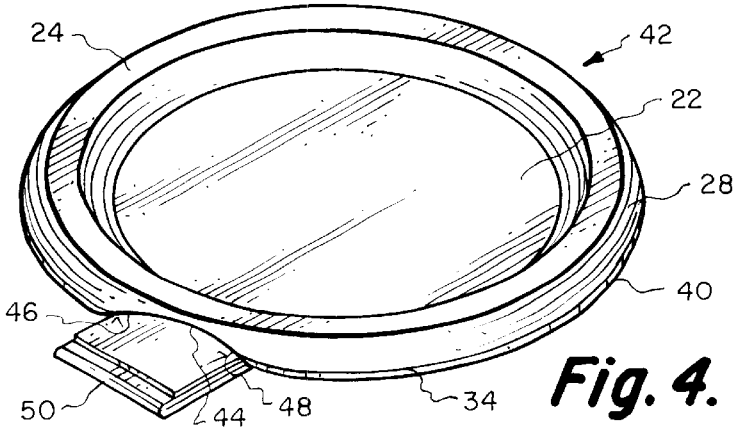
Fig. 4.

SPILL RESISTANT DISHWARE

This application claims the benefit of Ser. No. 60/383,276, filed May 23, 2002.

BACKGROUND OF THE INVENTION

1. Field of the Invention

The field of this invention relates to dishware and more particularly to dishware that resists spilling of food and also resists spilling of food by wind.

2. Description of the Related Art

The spilling of food in conjunction with dishware is an exceedingly common occurrence. People can contact a dish and cause the dish to be tipped or moved off of a table, counter or bench. Dishware that is designed particularly for outdoor usage has a further problem of being subjectable to wind. A breeze can cause a dish to be blown off a table, bench or counter.

Dishware that is designed particularly for outdoor usage is constructed of inexpensive sheet material, such as plastic or paper. Such dishware is exceedingly light in weight. Therefore, such dishware is readily susceptible to wind and can easily be blown off of a table. If the dish contains a substantial amount of food, usually the food is of sufficient weight to keep the dish stationary even in windy conditions. However, as the food is consumed, the dish will become lighter in weight and when the consumption of the food gets near to the point to where the dish is almost empty, the dish is quite susceptible to being tipped over by the wind. It would be desirable to design dishware that is designed primarily to be used in an outdoor environment to be temporarily fixable to a table, bench or counter that will resist the tipping over of the dishware by the wind.

There have been previous attempts at designing dishware to be wind resistant. Such dishware of the prior art have been constructed to include an adhesive along the entire bottom of the dish with the adhesive to then be applied to a table, bench or counter which will then function to hold in position the dish on the supporting surface. Typically, the adhesive is covered with a cover layer that is to be removed prior to usage. However, the removing of this cover layer does not permit easy and immediate usage of the dishware because of the additional step of removing the cover layer and then requiring disposal of the cover layer. Additionally, it is common for such dishware to be stacked and marketed in a stacked position prior to usage. It is a requirement that such dishware to be as sanitary as possible because such dishware will be directly used once the dishware is removed from its package. The fact that the food serving compartment will have been in direct contact with an adhesive layer of another dish is not conducive to a sanitary condition. There is always the worry that some of the adhesive, though non-toxic, could remain on a food receiving chamber of a food serving dish which is not conducive to clean usage.

SUMMARY OF THE INVENTION

The present invention is to provide spill resistant dishware that will remain upright when subjected to wind, vehicle motion and inadvertent contact with people or pets.

The first basic embodiment of the present invention comprises a food serving dish which has a food receiving chamber surrounded by a peripheral edge. An annular support flange is attached by a top edge to the peripheral edge. The annular support flange has an annular free edge with this annular free edge to rest on a supporting surface. An adhesive is applied to the annular free edge. The adhesive has a low tack which causes the dish to become fixed in position on a supporting surface but yet permits the dish to be easily manually moved having no residue on its supporting surface. The adhesive permits disengagement of the dish and resecurement of the dish on the supporting surface.

A further embodiment of the present invention is where the first basic embodiment is modified by the food receiving chamber having a planar bottom.

A further embodiment of the present invention is where the just previous embodiment is modified by the planar bottom being spaced from the supporting surface.

A further embodiment of the present invention is where the just previous embodiment is modified by the top edge being of a smaller diameter than the bottom edge.

A further embodiment of the present invention is where the first basic embodiment is modified by the adhesive completely covering the annular free edge.

A further embodiment of the present invention is where the first basic embodiment is modified by including of at least one opening in the annular support flange to facilitate insertion of a user's fingers and picking up of the food serving dish from the supporting surface.

A further embodiment of the present invention is where the shape of the opening includes flared ends which facilitates connection to a napkin to retain that napkin and keep that napkin from being blown by the wind.

A further embodiment of the present invention is where the first basic embodiment is modified by the food serving dish being defined as a bowl.

A further embodiment of the present invention is where the first basic embodiment is modified by the food serving dish being defined as a tray.

A further embodiment of the present invention is where the first basic embodiment is modified by the food serving dish being defined as a plate.

A further embodiment of the present invention is where the first basic embodiment is modified by the food serving dish being defined as a cup.

A second basic embodiment of the present invention comprises spill resistant dishware which includes an annular support sleeve which surrounds an internal chamber. The internal chamber is adapted to receive a beverage container with the beverage container being supported by the annular support sleeve. The annular support sleeve has an annular free edge with this annular free edge being adapted to rest on a supporting surface. An adhesive is applied to the annular free edge. The adhesive has a low tack which causes the annular support sleeve to be fixed in position on the supporting surface but yet permits the annular support sleeve to be easily manually moved leaving no residue on the supporting surface. The adhesive permits disengagement of the annular support sleeve and resecurement of the annular support sleeve on the supporting surface.

A further embodiment of the present invention is where the second basic embodiment is modified by there being included at least one longitudinal slit within the annular support sleeve to facilitate enlargement of the upper edge of the annular support sleeve in order to have the annular support sleeve to accommodate to larger sizes of beverage containers.

A further embodiment of the present invention is where the second basic embodiment is modified by the top edge of the annular support sleeve, which is a bead, being of a smaller diameter than the annular edge.

A further embodiment of the present invention is where the second basic embodiment is modified by the adhesive being applied entirely to the annular free edge of the annular support sleeve.

BRIEF DESCRIPTION OF THE DRAWINGS

For a better understanding of the present invention, reference is to be made to the accompanying drawings. It is to be understood that the present invention is not limited to the precise arrangement shown in the drawings.

FIG. 1 is an top isometric view of a plate of food serving dish of the present invention constructed in accordance with the features of the present invention;

FIG. 2 is a cross-sectional view through the plate of FIG. 1 taken along line 2—2 of FIG. 1;

FIG. 3 is a cross-sectional view similar to FIG. 2 but showing a plurality of the food serving dishes located in a stacked arrangement;

FIG. 4 is an isometric view similar to FIG. 1 but showing an opening formed within the annular support flange of the plate with this opening also being used to confine a napkin;

FIG. 10 is an isometric view of a modified form of beverage container food serving dish of the present invention which shows the beverage container located in a position about to be inserted in conjunction with an annular support sleeve of the food service dish.

DETAILED DESCRIPTION OF THE INVENTION

Figure 5:
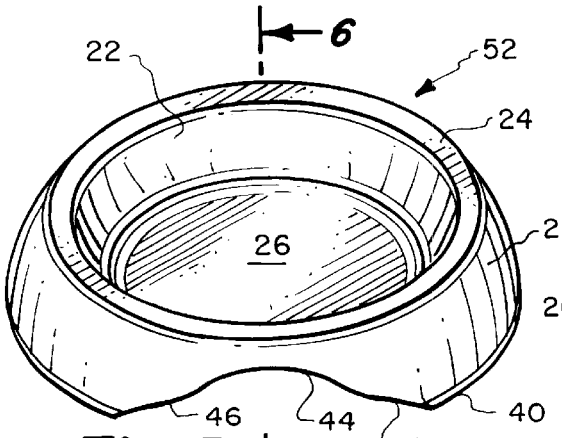
FIG. 5 is a top isometric view of a bowl configuration of food service dish of the present invention where the bowl includes an opening formed within the annular support flange of the bowl.

The present invention, which is to be described in detail utilizing the accompanying drawings, refers to dishes, such as plates, bowls, trays and beverage containers with a repositional and possibly pressure sensitive adhesive applied thereto. This adhesive is to prevent the dishware from being blown off a supporting surface when used outdoors in windy conditions or tipping and spilling when suggested to moderate physical force from a person or pet. The dishes are normally intended to be used one time and recyclable with normally the dishes to be constructed of paper, plastic, polystyrene or foam. However, the dishware of this invention could also be constructed of non-recyclable material.

Referring particularly to FIGS. 1–3 of the drawings, there is shown a food serving dish in the form of a plate 20. The plate 20 has an enlarged centrally located food receiving chamber 22 which has a top annular shaped edge 24 located at the upper surface of the plate 20. The food receiving chamber 22 has a bottom 26. The top annular shaped edge 24 is integrally connected to an annular support flange 28. The annular support flange 28 completely surrounds the food receiving chamber 22. Actually, there is formed a ring shaped chamber 30 which surrounds the portion 32 of the plate 20 that contains the food receiving chamber 22. Surrounding the ring shaped chamber 30 and integrally connected to the top annular shaped edge 24 is the annular support flange 28. It is to be understood that the plate 20 of this invention will normally be constructed of plastic, paper or foam.

The annular support flange 28 has an annular free edge 34. The annular free edge 34 is located within a plane 36. The bottom 26 may be is spaced from the plane 36 so that when the annular free edge 34 is located on a supporting surface 38, the bottom 26 may not be in contact with the supporting surface 38. An adhesive 40 is to be applied to the annular free edge 34. The adhesive 40 can completely cover the annular free edge 34 or can only cover part of the annular free edge 34 or can be applied within the annular free edge 34 and be pressure activated. However, it is believed to facilitate manufacture that normally the adhesive 40 will be applied to the entire annular free edge 34. It is to be noted that the adhesive 40, though non-toxic, will not come into contact with the food receiving chamber 22 of any other plate 20 even when they are in the stacked and nested arrangement shown in FIG. 3. In FIG. 3 there are three in number of the plates 20 shown in the stacked arrangement.

The adhesive 40 facilitates repositioning, has a low level of tackiness, is preferably non-toxic, odorless or may have a mild pleasant odor, resistant to moisture, resistant to microwaving and resistant to refrigeration and leaves no residue. It is preferable that adhesive 40 be biodegradable or recyclable. Examples of such adhesive are "Gel-Tac®"; "404 Spray N Fix®"; "Leeho 2 In 1 Glue Marker®D"; "Paste-N-Peel®" or an adhesive used in the popular "Post-It Notes®". The adhesive is preferred to have a peel strength of approximately 1.0–3.0 ounce per inch. The properties of the adhesive 40 will permit the user to easily lift the plate 20 from a surface on which it is temporarily secured with an amount of pressure which would be similar to one would use to pull a "Post-It Note®" from a surface on which the "Post-It Note®" is mounted. The adhesive 40 can be applied directly to the annular free edge 34 by creating an additional manufacturing process step whereby the adhesive 40 is sprayed, rolled, brushed, dipped or otherwise directly applied to the free edge 34 or the adhesive 40 can be applied indirectly to the free edge 34 such as at the same time that adhesive 40 is applied to other sections of a dish during a pre-existing manufacturing process step such as when adhesive is applied to the multiple layers of a multiple ply dish. If manufactured during such a pre-existing manufacturing process step, the adhesive 40 used can be a permanent and repositionable type of adhesive such as "Leeho 2 in 1 Glue", that will permanently adhere the multiple layers of the dish together yet will remain slightly tacky on the free edge 34. A pressure sensitive adhesive may also be used whereby the adhesive will not adhere to anything until a predetermined amount of pressure is applied, such as the pressure exerted within the die press or the pressure exerted when the consumer presses the new SPILL RESISTANT DISHWARE on a table or other surface. It is desirable to maintain the current speed of manufacture and to eliminate as many process steps as possible in the manufacture of the new SPILL RESISTANT DISHWARE in order to keep the manufacturing costs low and the manufacturer's profits up. The annular support flange 28 can be formed by modifying the shape of the rim forming section of existing molding machines or die presses used to make conventionally shaped dishes from plastic, foam or paper to form the shape of the annular support flange 28. It is very important that the dishes rest upon the annular support flange 28 and the free edge 34 so that when the dishes are stacked no adhesive 40 will come into contact with the food/drink holding compartments of the underlying dishes. The new SPILL RESISTANT DISHWARE can be manufactured at approximately the same speed and cost as conventional dishes with he added benefits of being spill, wind and slide resistant.

Referring particularly to FIG. 4 of the drawings, there is shown a modified form of plate 42 which is basically similar to plate 20 and like numerals have been utilized to refer to like parts. However, included within the annular support flange 28 is an opening 44. The opening 44 has flared ends 46 and 48. The idea of the flared ends 46 and 48 is to produce a thin slit at each end of the opening 44 that will facilitate the insertion and locking in place of an exterior structure, such as a napkin 50. Also, the flared ends 46 and 48 could be used to lock in place a utensil, such as a knife, fork or spoon where the utensil is constructed to be light in weight, usually of plastic. The optional opening 44 can be formed either by means of a mold in the case that the new SPILL RESISTANT DISHWARE will be molded from a paper slurry, plastic or foam or by cutting the opening 44 into a "blank" used to make the dishware by means of a die press.

Figure 7:
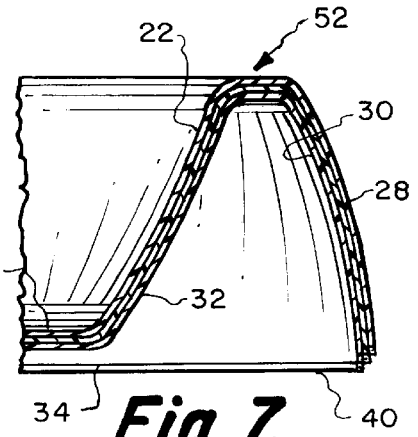
FIG. 7 is a cross-sectional view through the sidewall of the bowl of FIG. 5 however showing the food service dish of the present invention being mounted in a stacked relationship to other bowl type of food service dishes.
Figure 6:
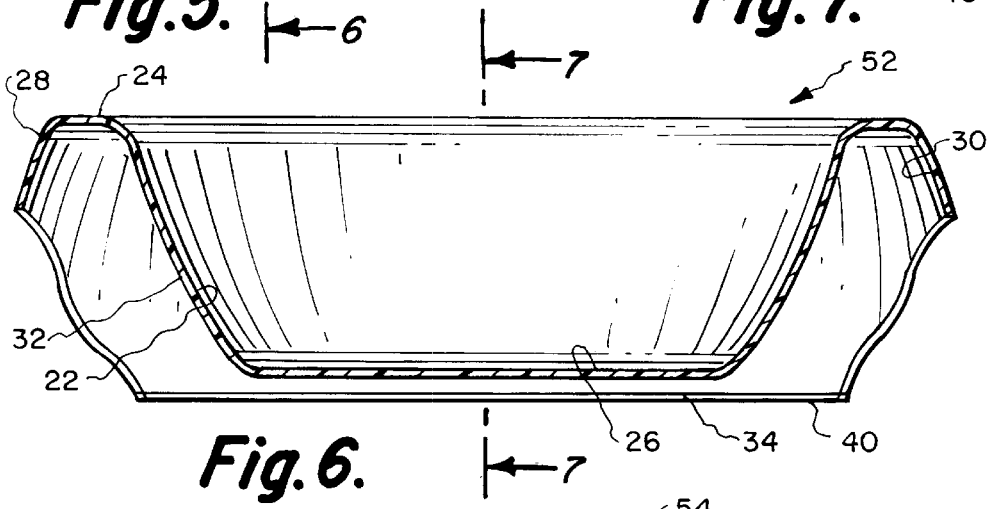
FIG. 6 is a cross-sectional view through the bowl food service dish of the present invention taken along line 6—6 of FIG. 5.

Referring particularly to FIGS. 5–7, there is shown a bowl 52 of food serving dish of this invention. The bowl 52 is constructed in a manner similar to plate 20 with again like numerals being used to refer to like parts. The only difference between the bowl 52 and the plate 20 is the fact that the food receiving chamber 22 is much deeper compared to the shallow chamber of the plate 20. The annular support flange 28 may also include an opening 44 with flared ends 46 and 48 which will operate in the same manner as previously described in relation to FIG. 4. The bowls 52 can also be stacked, as shown in FIG. 7.

Figure 8:
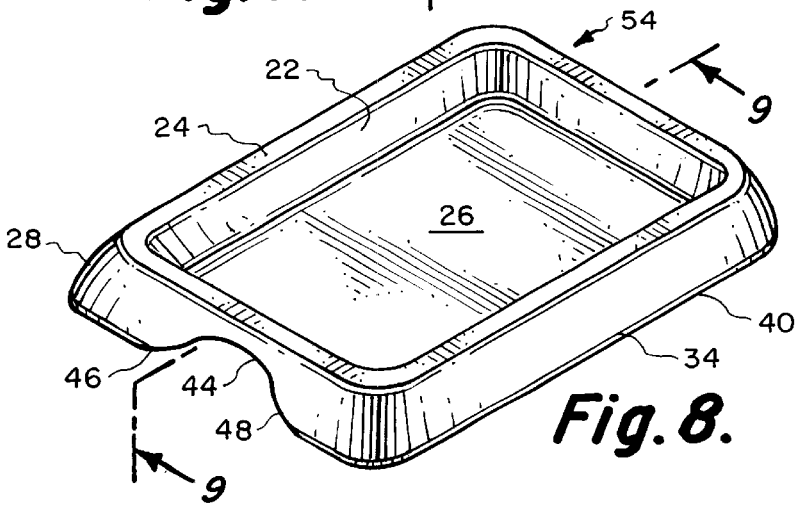
FIG. 8 is a top isometric view of a tray type of food service dish of the present invention.
Figure 9:
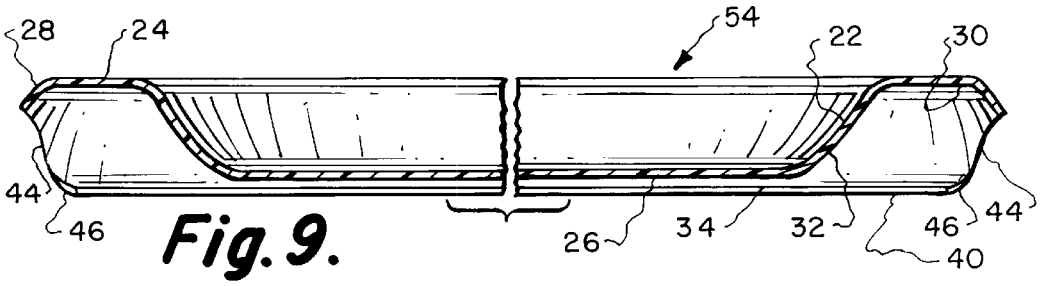
FIG. 9 is a cross-sectional view taken along line 9—9 of FIG. 8.

Referring particularly to FIGS. 8 and 9 of the drawings, there is shown a tray 54 of food serving dish of the present invention. Again, like numerals have been utilized to refer to like parts. The only difference of the tray 54 relative to the plate 20 and bowl 52 is that the food receiving chamber 22 is shallower than the food receiving chamber in conjunction with the bowl 52 and may be slightly deeper than the food receiving chamber in conjunction with the plate 20. Also, the food receiving chamber 22 is rectangular in configuration within the tray 54 where within the plate 20 and the bowl 52, the food receiving chamber 22 is round. The dishes of this invention may also, of course, be oval, square or other polygonal shape. There will generally be two of the openings 44 located at opposite ends of the tray 54. Normally, there will also be two in number of the openings 44 incorporated in conjunction with the bowl 52 and the plate 42.

Figure 10:
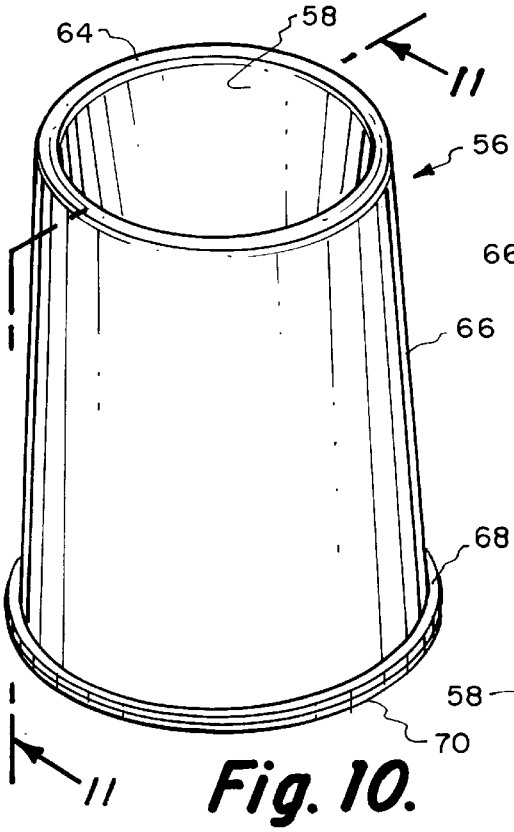
FIG. 10 is a top isometric view a beverage form of food serving dish of the present invention showing a plurality of the beverage dishes located in a stacked arrangement.
Figure 11:
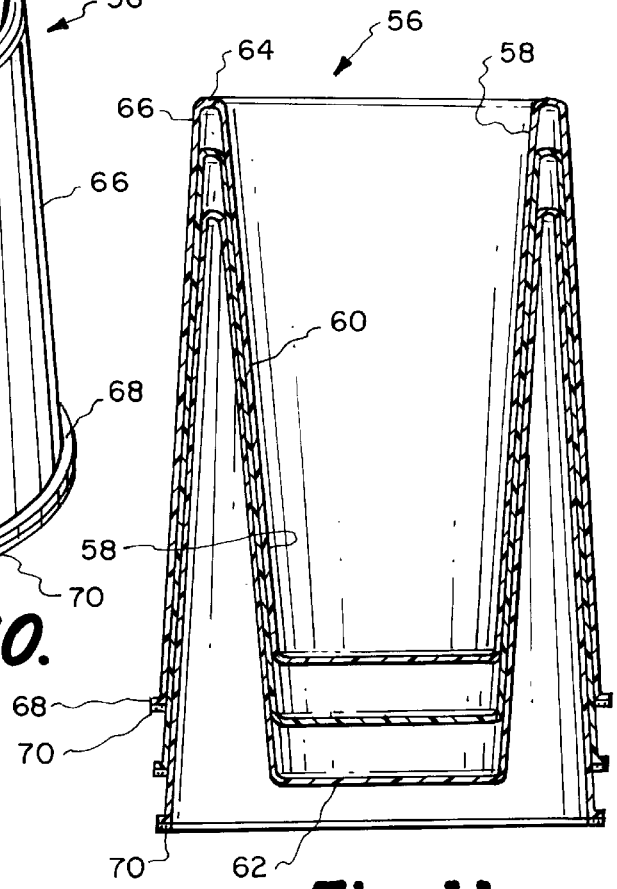
FIG. 11 is a cross-sectional view taken along line 11—11 of FIG. 10.

Referring particularly to FIGS. 10 and 11, there is shown a food serving dish in the form of a beverage dish 56 (cup). Again, the beverage dish 56 is constructed in a similar manner except the food receiving chamber 58 is much deeper than in any of the prior embodiments. It is within the food receiving chamber 58 there is to be normally located a liquid which is commonly known as a beverage such as water, soda or tea. The food receiving chamber 58 has a sidewall 60 which terminates at its lower end in a bottom wall 62. The sidewall 60 connects by an annular top edge 64 to an annular support sleeve 66. The annular support sleeve 66 terminates at a lower end in an annular free edge 68 which is slightly enlarged and which is covered by an adhesive 70. The height of the annular support sleeve 66 is such that when the adhesive 70 is placed against a supporting surface that the bottom wall 62 may be spaced a short distance from the supporting surface. The reason that it is desirable to keep the bottom wall 62, as well as bottom 26, from the supporting surface is that it is desirable to only achieve a minimal amount of securement with the supporting surface. If the entire surface of the bottom wall 62, or the bottom 26, was covered with adhesive and placed in contact with the supporting surface that it might very well, be difficult to disengage the food serving dish and reposition such. Additionally, if the adhesive 70 is applied to the free edge 68 of the beverage dish by rolling or brushing or by dipping the free edge 68 into the adhesive 70, it would facilitate ease of application to have the bottom 62 or 26 be slightly spaced from the plane of free edge 68 and the supporting surface thereby preventing the adhesive 70 from also being inadvertently rolled, brushed or dipped onto the bottom 62 or 26. If, however, the adhesive 70 is applied to the free edge 68 by some other means such as by spraying or by having been indirectly applied to the free edge 68 during the manufacture of a multiple ply beverage dish, then the bottom 62 or 26 need not be spaced from the plane of the free edge 68. The beverage form of food serving dish 66 can be readily stacked, as is clearly shown in FIGS. 10 and 11, with other similar dishes 56. Again, there is no adhesive 70 that ever comes into contact with any portion of the food receiving chamber 58 even when the beverage dishes 56 are located in the stacked relationship.

Figure 12:
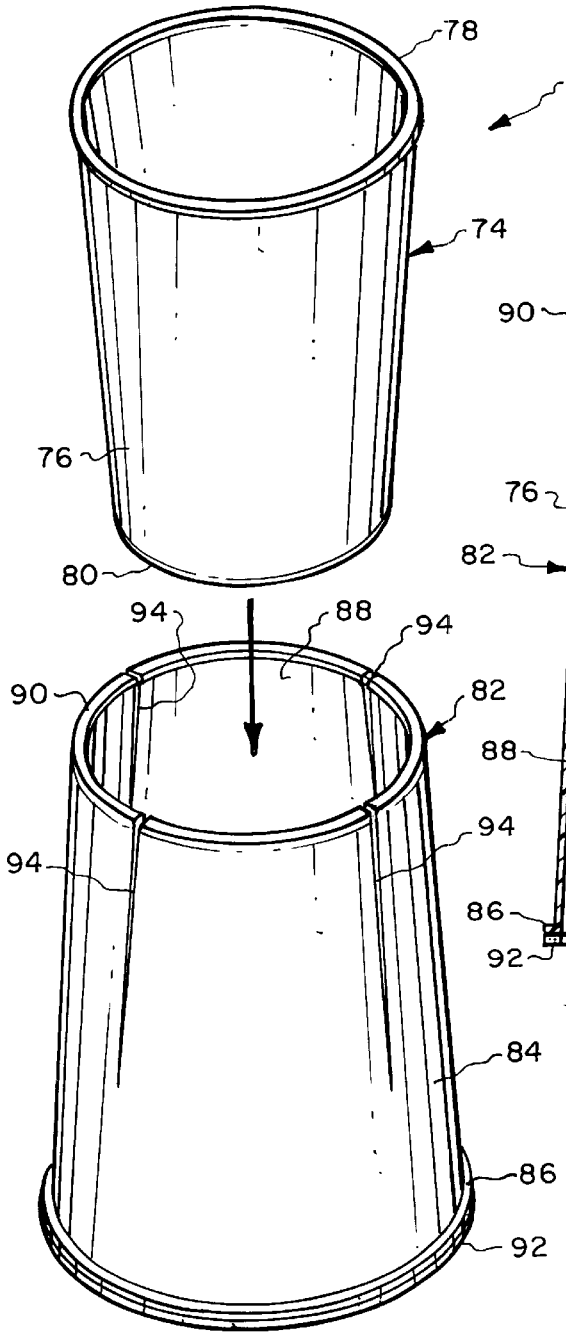
Figure 13:
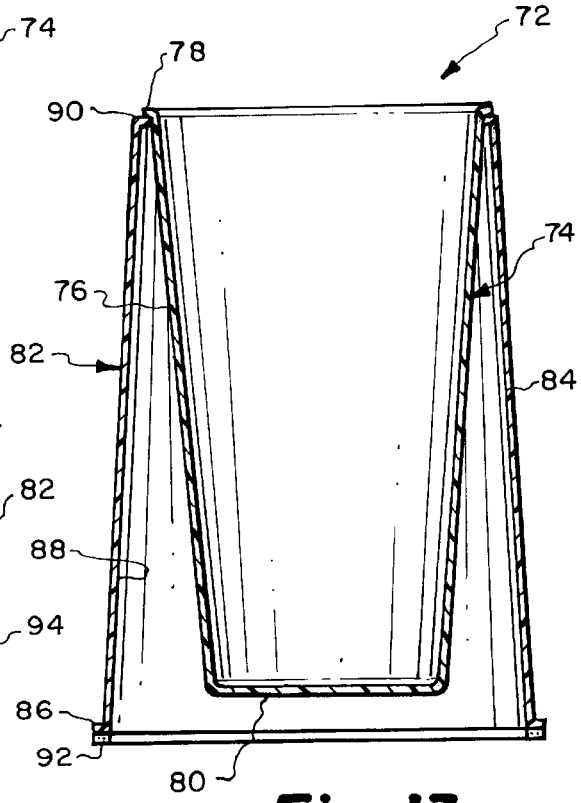
FIG. 13 is cross-sectional view through the food serving dish of FIG. 12 with the beverage container being contained in conjunction with the annular support sleeve.

Referring particularly to FIGS. 12 and 13, there is shown a further embodiment of food serving dish 72 of this invention. The dish 72 is again designed to be used with a beverage with the beverage to actually be contained within a conventional beverage cup 74. The beverage cup 74 has a sidewall 76 which terminates at its upper end in a bead. At the lower end, the sidewall is integrally connected to a planar bottom 80. It is to be understood that the bottom 80 is planar as is also bottom 26 and bottom 62. However, it is considered to be within the scope of this invention that the bottoms could be a slight arcuate configuration and not be planar. Also, the sidewall 76 is shown to be of a tapered frustoconical configuration, which is also shown in the previously described embodiments of the present invention. However, it is not mandatory that the shape of the beverage cup 74 be frustoconical.

The dish 72 includes a frustoconically shaped sleeve 82. The sleeve 82 has a tapered sidewall 84 which terminates in its lower end in an enlarged flange 86. Enlarging of the lower edge of the sleeve 82 by flange 86 is desirable to slightly increase the surface area available to the adhesive 92 placed thereon. This slight increase in area provides a significant increase in holding power on the supporting surface. The sleeve 82 has an internal chamber 88. The ring 82 has an annular bead 90 at its upper end thereof. The beverage cup 74 is to be merely slipped within the internal chamber 88 so that the bead 78 of the cup 74 rests on the bead 90. The bottom 80 of the beverage cup 74 may be spaced from the supporting surface again because the length of the sleeve 82 may be sufficient to make that occur. Normally, adhesive 92 will cover the entire enlarged flange 86 but such is not mandatory.

As a modification, if a slightly larger in size beverage cup 74 is utilized, the sleeve 82 can still be used by the including of a series of longitudinal slits 94 formed within the sidewall 84. These slits 94 will generally be of limited length, not extending any more than one-half the length of the sleeve 82. The slits 94 will generally be evenly spaced apart. The number of the slits 93 can be varied with generally four in number being preferred. The slits 94 will permit the area that is encompassed by the bead 90 to be enlarged in order to accommodate a slightly larger sized beverage cup 74. The benefits of the sleeve 82 is that it can be manufactured by means similar to those used to make conventional paper, plastic or foam cups. This is important since an economical product is mandatory in this field of this product if the product is to be financially beneficial to the manufacturer. Additionally, the sleeve 82 can be sold by the manufacturer in conjunction with their conventional cups as an accessory and will not compete directly with the sales of their conventional cups. A manufacturing example is that a sleeve may be created, as a conventional cup is, by forming it using conventional molding methods except that the step of forming the bottom of the cup is eliminated. Adhesive may then be applied to the flange 86 which may resemble the brim portion of a conventional cup, only inverted, thereby the sleeve 82 may be created. Alternatively, a multiple ply sleeve can be formed using the conventional means of creating a multiple ply cup and indirectly, when the adhesive is applied to adhere the plies together, adhesive can also be applied to the flange 86, again, the process step of where the bottom of the cup is usually attached is eliminated. Thereby the sleeve 82 may also be created. A conventional cup can then be slipped into the sleeve 82 and sold as one "Spill and Wind Resistant Cup" unit or the sleeves may be sold as separate "Spill and Wind Resistant Cup Sleeves". The assembled cup/sleeve units or separate sleeves can be stacked and no adhesive will come into contact with the liquid holding compartments of the underlying cups.

What is claimed is:

1. Spill resistant dishware comprising:

a food serving dish having a food receiving chamber surrounded by a peripheral edge;

an annular support flange attached by a top edge to said peripheral edge, said annular support flange having an annular free edge, said annular free edge adapted to rest on a supporting surface; and an adhesive applied to said annular free edge, said adhesive has a low tack which causes said dish to be fixed in position on the supporting surface but yet permits such dish to be easily manually moved leaving no residue on the supporting surface, said adhesive permitting disengagement of said dish and resecurement of said dish on a supporting surface with the intention being the force of the adhesive being sufficiently strong to maintain said dish in a fixed position on the supporting surface even during breezy conditions.

2. The spill resistant dishware as defined in claim 1 wherein:

said food receiving chamber having a planar bottom.

3. The spill resistant dishware as defined in claim 2 wherein:

said planar bottom being spaced from the supporting surface when said annular free edge is located on the supporting surface.

4. The spill resistant dishware as defined in claim 3 wherein:

said top edge being of a smaller diameter than said bottom edge.

5. The spill resistant dishware as defined in claim 1 wherein:

said adhesive completely: covering said annular free edge.

6. The spill resistant dishware as defined in claim 1 wherein:

said annular support flange including at least one opening, said opening facilitating manual insertion of a user's fingers to facilitate picking up and disengagement of said dish from the supporting surface.

7. The spill resistant dishware as defined in claim 6 wherein:

said opening having flared ends, each said flared end to be capable of functioning as a securement for an exterior structure, such as a napkin or utensil.

8. The spill resistant dishware as defined in claim 1 wherein:

said food serving dish comprising a bowl.

9. The spill resistant dishware as defined in claim 1 wherein:

said food serving dish comprising a tray.

10. The spill resistant dishware as defined in claim 1 wherein:

said food serving dish comprising a plate.

11. The spill resistant dishware as defined in claim 1 wherein:

said food serving dish comprising a cup.

12. Spill resistant dishware comprising:

an annular support sleeve surrounding an internal chamber, said internal chamber adapted to receive a beverage container with the beverage container being supported by said annular support sleeve, said annular support sleeve having an annular free edge, said annular free edge adapted to rest on a supporting surface; and an adhesive applied to said annular free edge, said adhesive has a low tack which causes said sleeve to be fixed in position on the supporting surface but yet permits, said dish to be easily manually moved leaving no residue on the supporting surface, said adhesive permitting disengagement of said sleeve from the supporting surface.

13. The spill resistant dishware as defined in claim 12 wherein:

said annular support sleeve having an upper edge, said upper edge being adapted to connect with the beverage container, at least one longitudinally oriented slit formed within said annular support sleeve, said slit connecting with said upper edge, whereby said slit permitting slight expansion and enlargement of the area enclosed by said upper edge permitting said annular support sleeve to connect with a plurality of different sizes of beverage containers.

14. The spill resistant dishware as defined in claim 12 wherein:

said upper edge being of a smaller diameter than said bottom edge.

15. The spill resistant dishware as defined in claim 12 wherein:

said adhesive completely covering said annular free edge.

* * * * *